United States Patent [19]

Horiuchi

[11] Patent Number: 4,511,259

[45] Date of Patent: Apr. 16, 1985

[54] BAR CODE INPUT ELECTRONIC TIMEPIECE

[75] Inventor: Teruo Horiuchi, Tokyo, Japan

[73] Assignee: Kabushiki Kaisha Daini Seikosha, Tokyo, Japan

[21] Appl. No.: 498,695

[22] Filed: May 27, 1983

[30] Foreign Application Priority Data

May 28, 1982 [JP] Japan ..... 57-91043

[51] Int. Cl.[3] ..... G04B 47/00

[52] U.S. Cl. ..... 368/10; 368/62; 368/69; 368/41

[58] Field of Search ..... 368/10, 62, 69, 41–44

[56] References Cited

U.S. PATENT DOCUMENTS 4,403,869 9/1983 Crutcher ..... 368/10

*Primary Examiner*—Bernard Roskoski

*Attorney, Agent, or Firm*—Robert E. Burns; Emmanuel J. Lobato; Bruce L. Adams

[57] ABSTRACT

An electronic timepiece inputs bar code data, decodes the data and displays decoded information represented by the bar code data. An optical sensor scans bar codes printed on a paper and inputs corresponding electrical bar coded data signals to an amplifier. A digitizer digitizes the amplified signals into serial digital signals which are decoded by a decoder into parallel bar-decoded data signals. A buffer memory temporarily stores the decoded data signals during read-in of the bar code data, and a memory control circuit controls the transfer of the decoded data signals from the buffer memory to a main memory. A selector circuit selects the decoded data signals from either the buffer memory or the main memory for visual display via a display decoder/driver circuit.

12 Claims, 7 Drawing Figures

A

BAR CODE INPUT ELECTRONIC TIMEPIECE

BACKGROUND OF THE INVENTION

This invention relates to input means for applying data into an electronic timepiece.

An electronic timepiece having the capability of receiving input data such as a telephone number, for example, from outside and storing the data has been known in the past. As the kinds of input data increases to include figures, alphabet, kana (Japanese Letter), and the like, however, the method of applying such data to the timepiece becomes a problem.

FIG. 1 illustrates an example of the conventional electronic timepiece having input means for inputting data. Characters such as figures and alphabet are shown disposed at the lower part of the timepiece and a corsor C represents that one of the characters is selected by denoting the selected character. By manipulating two switches A and B or by moving the corsor by the switch B, for example, the desired character is selected and when the A switch is pushed, the character thus selected is applied to a memory inside the timepiece.

However, this method has the disadvantage that the operation performance at the time of inputting the character is low and an extended period of time is necessary to input the data.

SUMMARY OF THE INVENTION

Accordingly, it is an object of the present invention to apply character data into an electronic timepiece with high operation performance by reading printed data on paper, such as bar code data, using an optical sensor incorporated in the electronic timepiece.

DESCRIPTION OF THE PREFERRED EMBODIMENT

Hereinafter, the present invention will be described in detail with reference to an example in which bar code data is applied to the timepiece.

Figure 1:
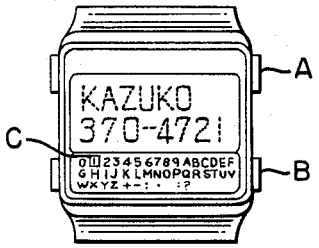
FIG. 1 PRIOR ART
FIG. 1 shows an example of a prior art electronic timepiece.
Figure 2:
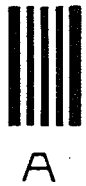
FIG. 2 shows an example of a bar code.

FIG. 2 illustrates an example of bar codes and the character "A" represented by the bar codes. A wide variety of bar codes are known and such codes vary in accordance with the features, applications, constructions, and the like. The example shown in FIG. 2 is a bar code called "CODE 39". CODE 39 is a bar code for figures and alphabets and consists of 9 bits per character. The data are represented using the wide bars and wide spaces as the binary logic "1" and the narrow bars and narrow spaces as the binary logic "0". The pattern of FIG. 2 represent the character "A" and the data represented by the bars is "10001" and the data represented by the spaces is "0010". This can be clearly understood by comparing the pattern width of the bars and spaces with the data.

Figure 3A:
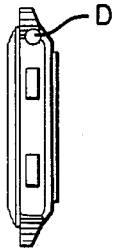
FIG. 3 shows an embodiment of the present invention, in which (a) is a side view and (b) is a front view, FIGS. 4(*a*) and 4(*b*) show the relation between the bar code and the reflected light when the bar code is scanned by the optical sensor.
Figure 3B:
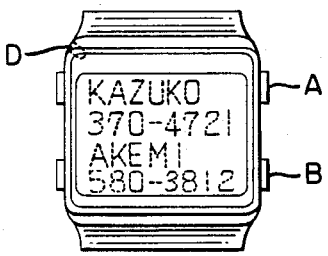

FIG. 3 shows an embodiment of the present invention, wherein FIG. 3(*a*) is a side view and FIG. 3(*b*) is a front view.

In this embodiment, a hole is bored on the side surface of the exterior part of the timepiece and a sensor D is embedded into the hole. In applying the data, the bar code shown in FIG. 2 is scanned by the sensor from the left to the right to select the character "A", and when a switch A is pushed, the selected character is applied to the memory inside the timepiece. A code table having the figures from 0 to 9, the alphabet of from A to Z or other symbols printed thereon is prepared, and the characters to be input are sequentially scanned by the sensor D. The characters can be stored in the memory inside the timepiece by then pushing the switch A.

Figure 4A:
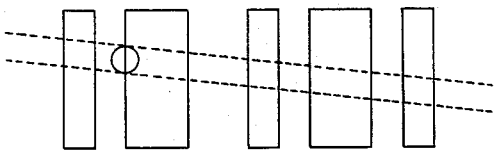
Figure 4B:
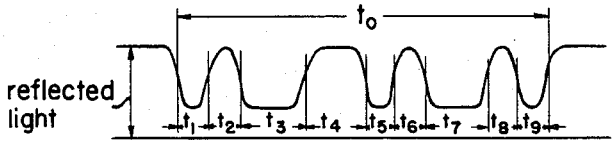

FIG. 4(*a*) shows an example of the code 39 bar code and FIG. 4(*b*) shows the reflected light when the bar code is scanned by the sensor D shown in FIG. 3. The dashed line represents the scanning path of the optical sensor. Hereinafter, the principle of decoding the bar code will be described with reference to FIG. 4. In the diagram, $t_0$ represents the total scanning time when the bar code of FIG. 4(*a*) is scanned. Symbols $t_1$–$t_9$ represents the scanning time for the bars and for the spaces. The code 39 bar code consists of 9 bits at least three bits of which are always "1". The data is contained in the width of the five bars and four spaces and the width of each bar and space representing the data "1" is twice that of each bar and space representing the data "0".

From the rule described above, if the bar code is scanned at a predetermined speed, the time $t_0/12$ is the time necessary for scanning the width of "0" and the time $t_0/6$ is the time necessary for scanning the width of the "1". Accordingly, the time reference for discriminating between "0" and "1" is set to $T=1.5\times(t_0/12)$ and judgement is made that the data is "1" when each time $t_1$ through $t_9$ is greater than the reference time T and is "0" when it is smaller than T. Accordingly, the 9 bits data can be decoded by measuring each of the times $t_0$, $t_1$ through $t_9$ by a counter and comparing the counted values of $t_1$ through $t_9$ with the T value obtained by counting $t_9$.

The above explains the principle of decoding the bar code decoder.

Figure 5:
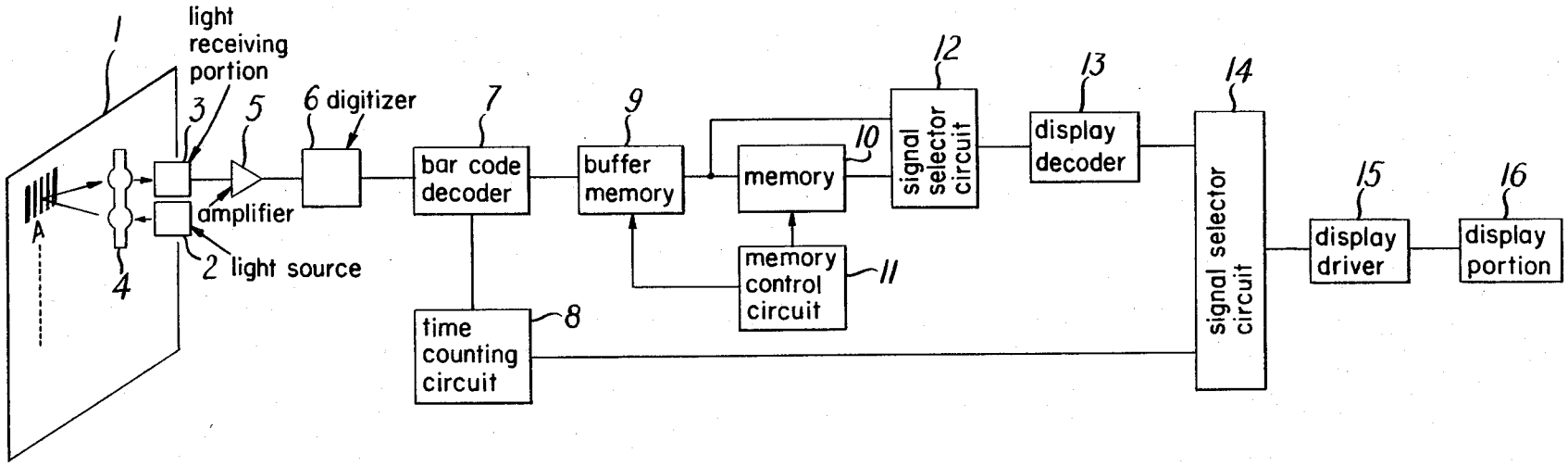
FIG. 5 is a block diagram of one embodiment of the present invention.

FIG. 5 is a schematic block diagram having one embodiment of the present invention. Reference numeral 1 represents a sheet of paper on which are printed a pattern bar codes representing selected information in the form of figures, alphabets and the like and characters corresponding to the bar codes.

Reference numeral 2 represents a light source such as a light emitting diode, for example, and reference numeral 3 represents a light receiving element such as a photo transistor. The elements 2 and 3 from an optical sensor in cooperation with an optical lens system 4 for improving the optical resolution. When the sensor scans the bar codes printed on the paper 1 at a predetermined speed, the light emitted from the light source 2 passes through the optical lens system 4 and is reflected, by the paper 1, passes through the optical lens system 4 again and is detected by the light receiving portion 3 as time sequenced light signals representing the light quantity and as time signals, as shown in FIG. 4(*b*). The detected signals are amplified by an amplifier 5 and applied to a digitizer 6, where the signals are compared at an appropriate threshold level and converted into corresponding digital signals which form a coded data signal in the form of a serial digital signal. In this manner, the optical sensor 2,3, the amplifier 5 and the digitizer 6 constitute read-in means for reading in bar code data representative of selected information from the pattern of bar codes.

The serial digital signal thus digitalized is applied as a coded data signal to a bar code decoder 7 and its time interval is counted by a clock signal of approximately 8 KHz supplied from a time counting circuit 8. The serial digital signal is then decoded or converted to a decoded data signal in the form of a parallel 9-bit data signal. The decoding circuit for code 39 is known in the art. The decoded 9-bit signal is applied to a buffer memory 9 and is temporarily stored in the memory.

A signal selector circuit 12 produces the data of the buffer memory when the bar code is read and produces the output data of the memory 10 when the stored data is read out. A second signal selector circuit 14 produces the time of the time counting circuit 8 in the time display mode and produces the output data of a display decoder 13 at other times.

When the bar code is read, the content of the buffer memory is converted to a data system suitable for display by the display decoder 13 through the signal selector circuit 12, then passes through the signal selector circuit 14 and is displayed at a display portion 16 through a display driver 15.

When scanning of the bar code is completed, the data that is temporarily stored in the buffer memory 9 is displayed at the display portion 16. When the content is displayed such as the display of FIG. 3(*b*), for example, the display content can be stored as a memorandum in the timepiece by pushing the A switch shown in FIG. 3 after the display content is confirmed.

A memory control circuit 11 produces a timing signal for storing the data of the buffer memory 9 in the memory 10 at the time of reading of the bar code by pushing the switch A and produces a reset signal to the buffer memory 9 for clearing the content of the buffer memory 9. The memory control circuit 11 also produces a signal for changing over the read/write state of the memory by the other switch operation shown in FIG. 3(*b*), and an address change-over switch for storing the content of the buffer memory 9 in several channels, to the memory 10. In other words, when the switch A is pushed, the line of characters that are applied by bar code scanning are stored in the memory inside the timepiece, so that the address selection signal designates the next address and the buffer memory can receive the next line of characters.

The foregoing illustrates the data input system into the electronic timepiece by reading the bar code, but reading of the stored data can additionally be made through the switch operation of the timepiece in the same way as in the prior art. When the timepiece is brought into the read mode by the switch operation, the memory control circuit 11 brings the memory 10 into the read state and designates the leading address of the memory. The output of the memory 10 passes through the signal selector circuit 12, is decoded into display signals in a system suitable for display by the display decoder 13, then passes through the signal selector 14 and is displayed at the display portion 16 by the driver 15. The time counting circuit 8 has the ordinary time counting function and when the timepiece is in the time display mode, it displays the time at the display portion 16 through the signal selector circuit 14 and through the driver 15. By such a construction, the signal selector circuit 12, the display decoder 13, the signal selector circuit 14 and the display driver 15 comprises read-out means for reading out the decoded data signals from the memory means 9, 10 and 11.

As described in the foregoing, the data input technique into the electronic timepiece in accordance with the present invention reads the printed bar codes and can simply apply all the data into the timepiece irrespective of the kinds of input characters and irrespective of the forms or shapes of the characters, character lines, sentences, and the like. Hence, the method of the present invention provides an extremely beneficial advantage that it has high maneuverability and freedom of operation.

If the light source is disposed outside the timepiece and the light passing through the bar code is received by the light receiving portion 3, the power consumption can be advantageously reduced.

What is claimed is:

1. In an electronic timepiece of the type having timekeeping means for keeping time and display means for visually displaying time information: read-in means for reading in bar code data representative of selected information in bar-coded form and producing corresponding coded data signals; decoding means for decoding the coded data signals and producing corresponding decoded data signals representative of the selected information in bar-decoded form; memory means for storing the decoded data signals; and read-out means for reading out the decoded data signals from the memory means and producing corresponding display drive signals and applying the display drive signals to the display means for visually displaying the selected information.

2. An electronic timepiece according to claim 1; wherein the read-out means includes first selecting means for alternatively selecting the decoded data signals read out from the memory means during reading in of the bar code data or at any desired time thereafter.

3. An electronic timepiece according to claim 2; wherein the read-out means includes second selecting means for selecting either a time display mode wherein the display means displays the time information or a selected information display mode wherein the display means displays the selected information.

4. An electronic timepiece according to claim 1; wherein the memory means comprises a buffer memory connected to receive and temporarily store the decoded data signals during reading in of the bar code data, a memory connected to receive the decoded data signals output from the buffer memory, and memory control circuit means for controlling the transfer of the decoded data signals from the buffer memory to the memory and for applying a reset signal to the buffer memory to clear the content thereof.

5. An electronic timepiece according to claim 4; wherein the read-out means comprises first signal selector circuit means for alternatively selecting the decoded data signals output from the buffer memory or the memory, a display decoder for decoding the decoded data signals selected by the first signal selector circuit means to produce corresponding display signals, and a display driver connected to receive the display signals and produce corresponding display drive signals for driving the display means to display the selected information.

6. An electronic timepiece according to claim 5; wherein the timekeeping means includes means for producing timing signals representative of time units to be displayed by the display means; and the read-out means includes second signal selector circuit means for alternatively selecting the display signals from the display decoder or the timing signals from the timekeeping means and applying the selected signals to the display driver.

7. An electronic timepiece according to claim 6; wherein the read-in means comprises optical sensing means disposed on a surface portion of the timepiece for time-sequentially sensing light signals representative of the bar code data which corresponds to the selected information and producing corresponding time-sequenced electrical signals, and a digitizer for converting the electrical signals into corresponding serial digital signals which comprise the coded data signals.

8. An electronic timepiece according to claim 7; wherein the decoding means comprises means for decoding the serial digital signals and producing corresponding parallel data signals which comprise the decoded data signals.

9. An electronic timepiece according to claim 7; wherein the optical sensing means comprises light-emitting means for irraditing light onto a light-reflective bar code pattern, and the light-receiving means for receiving light signals reflected from the light-reflective bar code pattern.

10. An electronic timepiece according to claim 1; wherein the read-in means comprises optical sensing means disposed on a surface portion of the timepiece for time-sequentially sensing light signals representative of the bar code data which corresponds to the selected information and producing corresponding time-sequenced electrical signals, and a digitizer for converting the electrical signals into corresponding serial digital signals which comprise the coded data signals.

11. An electronic timepiece according to claim 10; wherein the decoding means comprises means for decoding the serial digital signals and producing corresponding parallel data signals which comprise the decoded data signals.

12. An electronic timepiece according to claim 11; wherein the optical sensing means comprises light-emitting means for irradiating light onto a light-reflective bar code pattern, and light-receiving means for receiving light signals reflected from the light-reflective bar code pattern.

* * * * *